US006997332B1

(12) United States Patent
Alexander et al.

(10) Patent No.: US 6,997,332 B1
(45) Date of Patent: Feb. 14, 2006

(54) FIREWOOD RACK NEEDING NO FASTENERS TO ASSEMBLE

(75) Inventors: Don M. Alexander, Parsons, KS (US); Michael D. Alexander, Parsons, KS (US)

(73) Assignee: Alexander Manufacturing Co., Parsons, KS (US)

( * ) Notice: Subject to any disclaimer, the term of this patent is extended or adjusted under 35 U.S.C. 154(b) by 278 days.

(21) Appl. No.: 10/095,374

(22) Filed: Mar. 12, 2002

(51) Int. Cl.
*A47F 1/04* (2006.01)

(52) U.S. Cl. ..... 211/60.1; 211/182; 211/189

(58) Field of Classification Search ..... 211/60.1, 211/49.1, 189, 13.1, 182; D23/410; 312/265.1; 248/346.03, 150, 165; 182/178.1, 179.1
See application file for complete search history.

(56) References Cited

U.S. PATENT DOCUMENTS 3,157,424 A * 11/1964 Hall ..... 294/68.3
3,187,901 A * 6/1965 Wilson ..... 211/49.1
D243,504 S * 3/1977 Morrison ..... D23/410
D289,080 S * 3/1987 Einsel ..... D23/410
4,685,576 A * 8/1987 Hobson ..... 211/189
5,651,467 A * 7/1997 Moran, III ..... 211/49.1
6,290,073 B1 * 9/2001 Barnes et al. ..... 211/189

* cited by examiner

*Primary Examiner*—Carl D. Friedman
*Assistant Examiner*—Jennifer E. Novosad
(74) *Attorney, Agent, or Firm*—Robert Nathans

(57) ABSTRACT

A four piece firewood rack has left-hand and right-band end sections, each section including a horizontal cross-beam welded between lower portions of a vertical beam to be positioned at the front of the rack and lower portions of a second left-hand beam at the rear of the rack, a third horizontal cross-beam, having sleeves members welded to terminal portions of the third cross-beam, are passed over the vertical beams at the front of the rack until they rest upon the cross-beams of each end section without the need for fasteners, and a fourth horizontal cross-beam, having sleeve members welded to terminal portions of the fourth cross-beam, are passed over the vertical beams at the rear of the rack until they rest upon the cross-beams of each end section without the need for fasteners.

3 Claims, 1 Drawing Sheet

FIREWOOD RACK NEEDING NO FASTENERS TO ASSEMBLE

BACKGROUND OF THE INVENTION

The present invention relates to the field of firewood racks.

Various firewood racks are disclosed in the prior art for storing cut logs of firewood for use in fireplaces. U.S. Pat. No. 4,971,207 to Baucom discloses a simple basic firewood rack design employing horizontal and vertical tubing elements that would be relatively unsturdy in use and would take up substantial space upon being packed and shipped. Other prior art designs employ fasteners for fastening the various shipped members together, which process can be a nuisance for the purchaser of the rack. This is particularly true for senior citizens and others who avoid use of any type of tool however simple. The use of tools also takes time and effort and ease of assembly is of paramount importance. The more components there are to assemble, the more confusing it can be for many people.

Prior designs call for the undesirable use of tools, after the components are shipped in reasonably sized containers, for assembly by the purchaser, and have other drawbacks as well. Firewood racks when assembled take up substantial space. See for example, Noll U.S. Pat. No. 5,743,413 and Visneski U.S. Pat. No. 3,021,011. The latter design calls for a rack supported on a wheeled platform employing fasteners for component assembly, and which could damage flooring when wheeled about and, in larger sizes, could be unstable.

Moran U.S. Pat. No. 5,779,063 discloses a relatively complex design calling for eight components to be assembled together, in contrast with only four components to be assembled in accordance with the present invention. Also, the rack uses six wooden beams or timers that makes it harder to assemble, particularly if the purchaser has to go to a lumber yard to obtain the wooden beams. Also the remaining two multi-component metal coupling members have eight original pieces that have to be welded together, increasing manufacturing cost.

Barnes, U.S. Pat. No. 6,290,073 doesn't appear to need fasteners to assemble his firewood rack, but it is more complex than the present invention because we are using four vertical tubes also as part of our connecting device to our two horizontal tubes. Production cost to make the rack of the claimed invention is lower as we only have to cut twelve pieces of standard hollow square tubing and make eight weld joints. Following the Barnes design, eighteen pieces of tubing would be required along with 16 welds. Furthermore, the male members at the ends of the horizontal Barnes tubes only slide into the receives 18 to a two inch depth so that any obstruction below his bottom two tubes that would raise them by only two inches, would allow the ends of the rack to fall over if placed under any load, because male members 22 would pop out of receives 18. Because our horizontal log supporting tubes slide completely down to our lower end-section cross-members, our simpler design would not have this drawback. Also, we do not employ his top horizontal tubes 16, which result in an unnecessary additional cost, and actually are in the way of any adjusting cover that allows air flow to the firewood.

SUMMARY OF A PREFERRED EMBODIMENT OF THE INVENTION

It is thus a principal object of the present invention to provide an extremely simple four component firewood rack that requires no tools for assembly, takes virtually no time to assemble, and has a very low manufacturing cost, relative to prior art firewood rack designs.

A left hand end section is provided and includes a first horizontal cross-beam (3) directly connected by welding between lower portions of a first vertical left hand beam (1) at the front of the rack and a second vertical left hand beam (1*a*) at the rear of the rack; a right hand end section is also provided and includes a second horizontal cross-beam (3*a*) directly connected by welding between lower portions of a first vertical right hand beam (1) at the front of the rack and a second vertical right hand beam (1*a*) at the rear of the rack. A third horizontal firewood supporting cross-beam (4) is coupled between lower portions of the first left hand beam at the front of the rack and lower portions of the first right hand beam at the front of the rack via first and second fasten-less sleeve members (2) respectively, and in the like manner a fourth horizontal firewood supporting cross-beam (4*a*) is coupled between lower portions of the second left hand beam at the rear of the rack and lower portions of the second right hand beam at the rear of the rack via third and fourth fasten-less sleeve members (2*a*) respectively. All four fasten-less sleeve members are slipped over the four vertical beams easily and rapidly without tools.

BRIEF DESCRIPTION OF THE DRAWINGS

Other objects, features and advantages will become more apparent upon study of the following detailed description, taken in conjunction with the drawings in which.

DETAILED DESCRIPTION OF THE PREFERRED EMBODIMENT OF THE INVENTION

Figure 3:
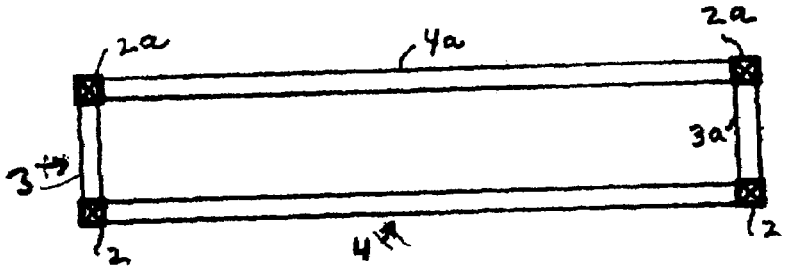
FIG. 3 illustrates a top view of the rack.
Figure 2:
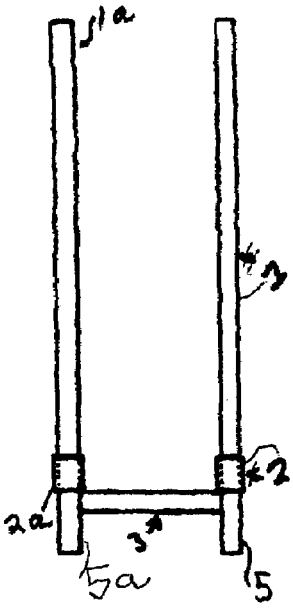
FIG. 2 illustrates a side or even view of the rack.
Figure 1:
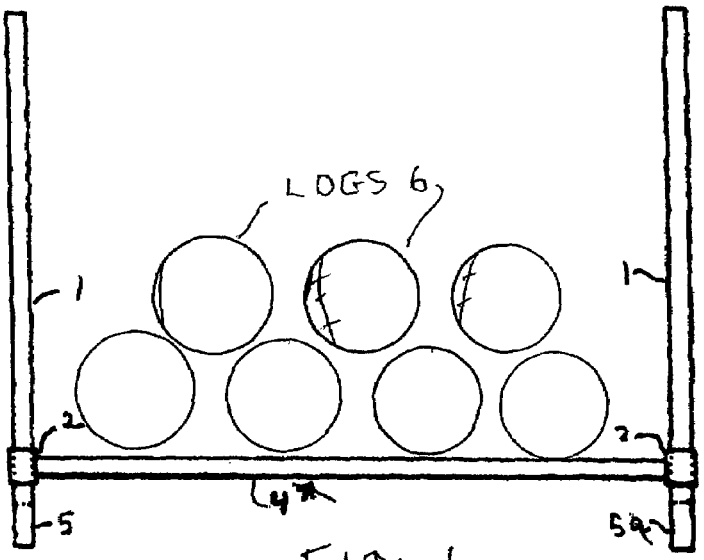
FIG. 1 illustrates a front view of the firewood rack.

A left hand end section shown more fully in FIG. 2, consists of two vertical tubes 1 and 1*a* welded to a horizontal cross-beam member 3. By positioning the cross-beam member 3 near the bottom of the rack, a pair of support members or feet 5 are formed, that contact the floor. A similar right hand end section includes a like cross-beam 3, welded to a second pair of vertical tubes 1 and 1*a* to form feet 5*a*. Front and back long horizontal tube sections 4 and 4*a* are provided, each having short tubular sleeves 2, welded to the ends of the horizontal tube sections as shown in FIGS. 1 and 3. The longitudinal tube sections support the firewood logs 6 as illustrated.

Upon assembly after shipment of the rack components, the sleeves 2 at the ends of the front long horizontal beam 4 are slipped over the vertical tubes 1 at the front of the rack and sleeves 2*a* at the ends of the rear long horizontal beam 4*a* are slipped over the vertical tubes 1*a* at the rear portion of the rack, as shown in FIGS. 2 and 3. Each long horizontal beam 4 then rests against the aforesaid horizontal cross-beam members as shown in FIGS. 1 and 2 and thus the assembly of the rack is easily and rapidly accomplished without tools, enabling virtually anyone to assemble the rack without aggravation.

Besides ease of assembly, the manufacturing cost of the rack is very low, as fasteners are not used for assembly, and the components can all be cut from the same hollow light weight tubular stock. Only four components are supplied to the user, thereby to provide the essence of simplicity. As the components are substantially flat, shipping space and shipping cost are minimized.

As variations of the foregoing detailed description will be apparent to the skilled worker in the art, the scope of the invention is to be limited solely to the terms of the following claims. For example the cross sections of the tubular beams could be circular, triangular or virtually any other shape so long as sufficient clearance is provided between the inner sleeve surfaces and the vertical tubes. The sleeve fit should be snug without being too tight, which would invite jamming. The racks made in accordance with the invention preferably have sleeve clearances of about an eighth of an inch. An equivalent arrangement with respect to the one described, would be to weld each long horizontal tube 4 and 4*a* directly between a pair of vertical tubes and weld a pair of short sleeves 2 to the ends of each individual short cross-bar 3, separated from the vertical tubes, and that could be slipped over pairs of front and rear vertical tubes. However, this is less desirable as the front and rear "H-shaped" components would take up more shipping space than the preferred embodiment of the invention described. If the feet 5 were omitted, the horizontal beams could even contact the floor, which however is less desirable as ventilation of the wood is preferred. Other hand the short tubular sleeves, the beams could be solid rods rather than hollow tubes, although this would be less desirable as the shipping weight would be increased. Also, the sleeves need not completely surround the beams to which they are coupled. For example, the sleeves could have "C" or "U" shaped cross sections. Of course, readily available square or round hollow tubing, completely surrounding the beams is greatly preferred.

What is claimed is:

1. A method of enabling a purchaser of firewood rack components from a supplier to rapidly assemble the firewood rack without tools or labor comprising the steps of:

(a) providing the following firewood rack components to said purchaser:

(a-1) a left hand end section including a first horizontal cross-beam permanently affixed to a lower portion, but not the bottom of, a first vertical left hand beam without the use of fasteners and permanently affixed to a lower portion, but not the bottom of, a second vertical left hand beam without the user of fasteners;

(a-2) a right hand end section including a second horizontal cross-beam permanently affixed to a lower portion, but not the bottom of, a first vertical right hand beam without the use of fasteners, and permanently affixed to a lower portion, but not the bottom of, a second vertical right hand beam without the use of fasteners;

(a-3) third and fourth horizontal cross-beams for supporting firewood logs having sleeve members permanently affixed to both terminal portions of said third horizontal cross-beam without the use of fasteners, and permanently affixed to both terminal portions of said fourth horizontal cross-beam without the user of fasteners;

(b) upon receipt of the firewood rack components from said supplier, passing the sleeve members of said third cross-beam over upper portions of the first vertical left hand beam and the first vertical right hand beam until the sleeve members thereof rest upon the first and second cross-beams, to be supported thereby without the use of fasteners; and (c) upon receipt of the firewood rack components from said supplier, passing the sleeve members of said fourth cross-beam over upper portions of the second vertical left hand beam and upper portions of the second vertical right hand beam until the sleeve members thereof rest upon the first and second cross-beams, to be supported thereby without the use of fasteners.

2. A method of enabling a purchaser of firewood rack components provided by a supplied to rapidly assemble the firewood rack without tools or labor comprising the steps of:

(a) providing the following firewood rack components to said purchaser;

(a-1) a left hand end section including a first horizontal metallic cross-beam welded to a lower portion, but not the bottom of, a first vertical left hand metallic beam without the use of fasteners and welded to a lower portion, but not the bottom of, a second vertical left hand metallic beam without the use of fasteners;

(a-2) a right hand end section including a second horizontal metallic cross-beam welded to a lower portion, but not the bottom of, a first vertical right hand metallic beam without the use of a fasteners, and welded to a lower portion, but not the bottom of, a second vertical right hand metallic beam without the use of fasteners;

(a-3) third and fourth horizontal metallic cross-beams for supporting firewood logs having sleeve members affixed to both terminal portions of said third horizontal metallic cross-beam without the use of fasteners, and affixed to both terminal portions of said fourth horizontal metallic cross-beam without the use of fasteners;

(b) upon receipt of the firewood rack components from said supplier, passing the sleeve members of said third metallic cross-beam over upper portions of the first vertical left hand metallic beam and the first vertical right hand metallic beam until the sleeve members thereof rest upon the first and second metallic cross-beams, to be supported thereby without the use of fasteners; and (c) upon receipt of the firewood rack components from said supplier, passing the sleeve members of said fourth metallic cross-beam over upper portions of the second vertical left hand metallic beam and upper portions of the second vertical right hand metallic beam until the sleeve members thereof rest upon the first and second metallic cross-beams, to be supported thereby without the use of fasteners.

3. A method of enabling a purchaser of firewood rack components provided by a supplier to rapidly assemble the firewood rack without tools or labor comprising the steps of:

(a) providing the following firewood rack components to said purchaser;

(a-1) a left hand end section including a first horizontal metallic cross-beam welded to a lower portion, but not the bottom of, a first vertical left hand metallic beam without the use of fasteners and welded to a lower portion, but not the bottom of, a second vertical left hand metallic beam without the use of fasteners;

(a-2) a right hand end section including a second horizontal metallic cross-beam welded to a lower portion, but not the bottom of, a first vertical right hand metallic beam without the use of fasteners, and welded to a lower portion, but not the bottom of, a second vertical right hand metallic beam without the use of fasteners;

(a-3) third and fourth horizontal metallic cross-beams for supporting firewood logs having sleeve members affixed to both terminal portions of said third horizontal metallic cross-beam without the use of fasteners, and affixed to both terminal portions of said fourth horizontal metallic cross-beam without the use of fasteners;

(b) upon receipt of the firewood rack components from said supplier, passing the sleeve members of said third metallic cross-beam over upper portions of the first vertical left hand metallic beam and the first vertical right hand metallic beam until the sleeve members thereof come to rest over the first and second metallic cross-beams, without the use of fasteners; and (c) upon receipt of the firewood rack components from said supplier, passing the sleeve members of said fourth metallic cross-beam over upper portions of the second vertical left hand metallic beam and upper portions of the second vertical right hand metallic beam until the sleeve members thereof come to rest over the first and second metallic cross-beams, without the use of fasteners.

* * * * *